US006102586A

United States Patent [19]

Isokawa et al.

[11] Patent Number: 6,102,586

[45] Date of Patent: Aug. 15, 2000

[54] PHOTOSENSITIVE MATERIAL PROCESSING APPARATUS

[75] Inventors: Wataru Isokawa; Eiji Ito, both of Hino; Munehiro Yasuda; Benzo Nakata, both of Itami, all of Japan

[73] Assignee: Konica Corporation, Tokyo, Japan

[21] Appl. No.: 09/246,856

[22] Filed: Feb. 9, 1999

[30] Foreign Application Priority Data

Feb. 10, 1998 [JP] Japan ..... 10-044505

[51] Int. Cl.[7] ..... G03D 3/08

[52] U.S. Cl. ..... 396/570; 396/612; 396/620; 396/622; 396/652

[58] Field of Search ..... 396/612, 617, 396/620, 622, 646, 651, 652, 570

[56] References Cited

U.S. PATENT DOCUMENTS 4,005,464 1/1977 Krehbiel ..... 396/622

4,045,809 8/1977 Landers ..... 396/622

5,453,810 9/1995 Todoki ..... 396/620

5,708,906 1/1998 Hashizume ..... 396/620

*Primary Examiner*—Alan A. Mathews

*Attorney, Agent, or Firm*—Finnegan Henderson Farabow Garrett & Dunner, LLP

[57] ABSTRACT

There is described a photosensitive material processing apparatus which automatically develops pieces of film being longer in the longitudinal direction than in the width direction like a piece of photographic film for consumer use. The photosensitive material processing apparatus, embodied in the present invention, includes an ejecting section to eject a photosensitive material, a storing section to store a plurality of photosensitive materials and a conveyor for moving to the storing section while supporting a leading portion of the photosensitive material.

9 Claims, 23 Drawing Sheets

PHOTOSENSITIVE MATERIAL PROCESSING APPARATUS

BACKGROUND OF THE INVENTION

This invention relates to a photosensitive material processing apparatus and a photosensitive material processing method, and in particular, to a photosensitive material processing apparatus and method, wherein film pieces ejected from an ejecting portion are successively transported to a receiving means by a movable holding means, and the leading edge portions of these transported film pieces are held as trued up by the receiving means, while other portions of the film pieces except the leading edge portions are placed on an accumulating portion, so that it may be prevented that the image surface of any one of the film pieces are rubbed and damaged by the side edges of other film pieces, by preventing that the respective film pieces are rubbed by others after ejection through holding the ejected film pieces stably.

It has been heretofore known a photosensitive material processing apparatus automatically developing pieces of film (photosensitive material) which are longer in the longitudinal direction than in the width direction like a piece of photographic film. FIG. 18 shows a conventional photographic material processing apparatus 10.

In this photosensitive material processing apparatus 10, the leader 1 for transport as shown in FIG. 19 is ordinarily used in transporting film pieces in the apparatus. In the same drawing, the leader 1 is a thin plate made of a resin, and the engaging holes 3 for engaging with the gear for transporting arranged in the apparatus (not shown in the drawing) are bored in a line at the center of this leader 1. The leading edge portions of, in this example, two film pieces are put onto the leader 1 made up in the above-mentioned manner by the sticking tapes 2 respectively.

In FIG. 18, the leader 1 having the film pieces put on in this manner is inserted into the inserting portion 4 provided at the front side of the apparatus, and is ejected to the leader receiving portion 5 after the film pieces are subjected to the specified processing based on the setting in the operation portion 7.

In this case, as shown in FIG. 20, the inserted film pieces are transported into the liquid tank 6 and are subjected to the predetermined processes required for developing by being dipped successively in a plurality of processing liquids of different kinds. Then, the leader 1 ejected to the outside together with the film pieces are held by the leader receiving portion 5 disposed at a relatively high position in the apparatus mainframe.

As shown in FIG. 21, the leader receiving portion 5 is composed of the engaging bar 8 for engaging with the central portion of the lower end surface of the leader 1 and the holding plates 9 for regulating the holding position of the leader 1 from both sides. By the leader receiving portion 5 made up in this manner, a plurality of the leaders 1 are held as shown in FIG. 20.

Incidentally, as shown in FIG. 20, in the conventional photosensitive material processing apparatus 10, the ejected film pieces are hanging down from the leader 1 in an unstable manner without being held directly.

For this reason, the free end portions of the film pieces are easily oscillated even though a very week external force such as wind influences them; hence, especially in a condition that a plurality of the film pieces are accumulated, it has occurred a problem that the respective film pieces are rubbed by others and the image surface of any one of the film pieces are damaged by the side edges of other film pieces even though the ejected film pieces are simply left as they are.

SUMMARY OF THE INVENTION

Therefore, this invention has been made for solving the above-mentioned problem, providing a photosensitive material processing apparatus and a photosensitive material processing method both capable of holding the film pieces stably after having been ejected.

In order to solve the above-mentioned problem, the photosensitive material processing apparatus of this invention is made the one which automatically ejects film pieces from an ejection portion after executing predetermined processes on the way of transporting and accumulates them on an accumulating portion, further comprising a movable holding means for holding the leading edge portions of the film pieces ejected from the ejection portion to move them to a predetermined position and a receiving means for receiving and holding the leading edge portions of the film pieces moved by the movable holding means, wherein the leading edge portions of the film pieces are held in a manner such that they are trued up in a definite direction, while the other portions except the leading edge portions are accumulated on the accumulating portion.

According to this invention, the film pieces ejected from the ejection portion are successively transported to the receiving means by the movable holding means. The leading edge portions of these transported film pieces are held as trued up by the receiving means, while the other portions of the film pieces except the leading edge portions are placed on the accumulating portion. Accordingly, the ejected film pieces are held stably by the receiving means and the accumulating portion, and it can be prevented that the image surface of any one of the film pieces are rubbed and damaged by the side edges of other film pieces, because the respective film pieces are never rubbed by others after being ejected.

DETAILED DESCRIPTION OF THE PREFERRED EMBODIMENTS

Next, an example of the embodiment of the photosensitive material processing apparatus and the photosensitive material processing method according to this invention will be explained in detail with reference to the drawings.

Figure 1:
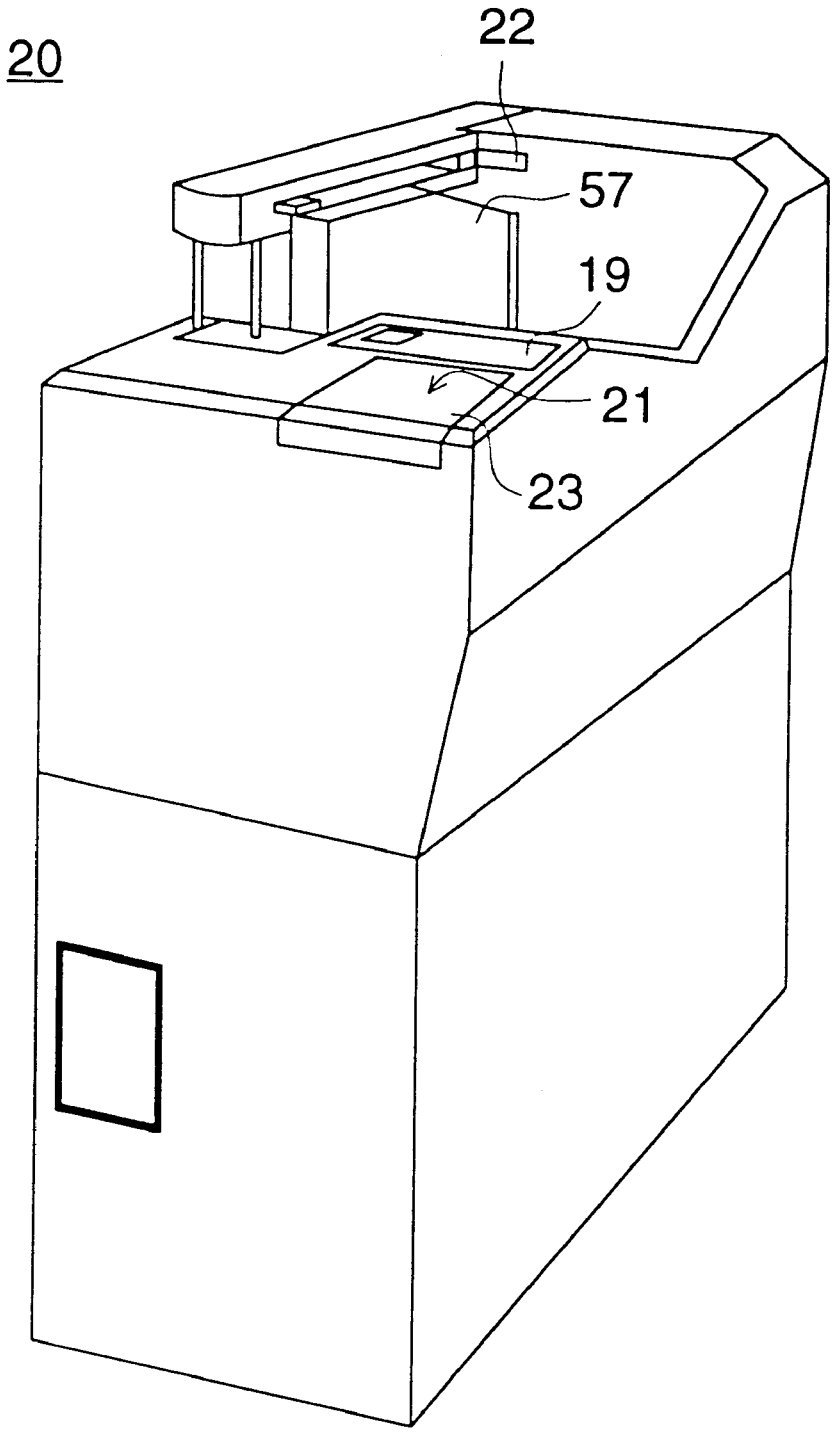
FIG. 1 is a perspective view of the photosensitive material processing apparatus 20 of this invention.

FIG. 1 shows the photosensitive material processing apparatus 20 according to this invention. This invention is the one such that the pieces of the film (photosensitive material) ejected out of an ejection portion are successively transported to a receiving means by a movable holding means, their leading edge portions are held as trued up by the receiving means, and at the same time, the other portions of them except the leading edges are placed on the accumulating portion, so that the ejected film pieces may be stably held.

This photosensitive material processing apparatus 20 is the one for automatically developing the film pieces which are longer in the longitudinal direction than in the width direction, and is made up to automatically eject the film pieces after being subjected to the predetermined processes on the way of transportation.

Further, in the photosensitive material processing apparatus 20, several kinds of films having different widths to one another such as a 135 mm film (a film having a width of 35 mm), an IX240 film (a film having a width of 24 mm), and a 110 film (a film having a width of 16 mm) can be used.

In transporting the film pieces, it is necessary to unify the widths of at least the leading edge portions of the film pieces to be transported; in this example, in the case where the film to be develop-processed is a 135 mm film, the film piece itself is to be transported as it is, and in the cases of an IX240 film and a 110 film, the film pieces are to be transported with a thin plate (a leader) having a width of about 35 mm made of a resin put on at their leading edges by means of a sticking tape.

These film pieces are received, for example, in a nearly cylindrical cartridge for exclusive use, which has usually a shape varied according to the size of the film. Owing to that, when a film piece is set in the photosensitive material processing apparatus 20, it is necessary the operation to take out the film piece momentarily and to transfer it into an intermediate cartridge for setting it in the apparatus.

In this embodiment of the invention, the cartridge can be used as it is without being exchanged in case of setting a 135 mm film. An IX240 film and a 110 film are to be transferred into intermediate cartridges for exclusive use respectively (hereinafter, an intermediate cartridge is also referred to as a cartridge).

Now, regarding the photosensitive material processing apparatus 20 shown in FIG. 1, a film piece is set on the inserting portion of this side at the upper part of the apparatus, processed in the apparatus in accordance with the setting of the operating portion 19, then ejected through the ejection hole (ejecting portion) 22 formed at the deeper side of the uppermost part of the apparatus.

Figure 2:
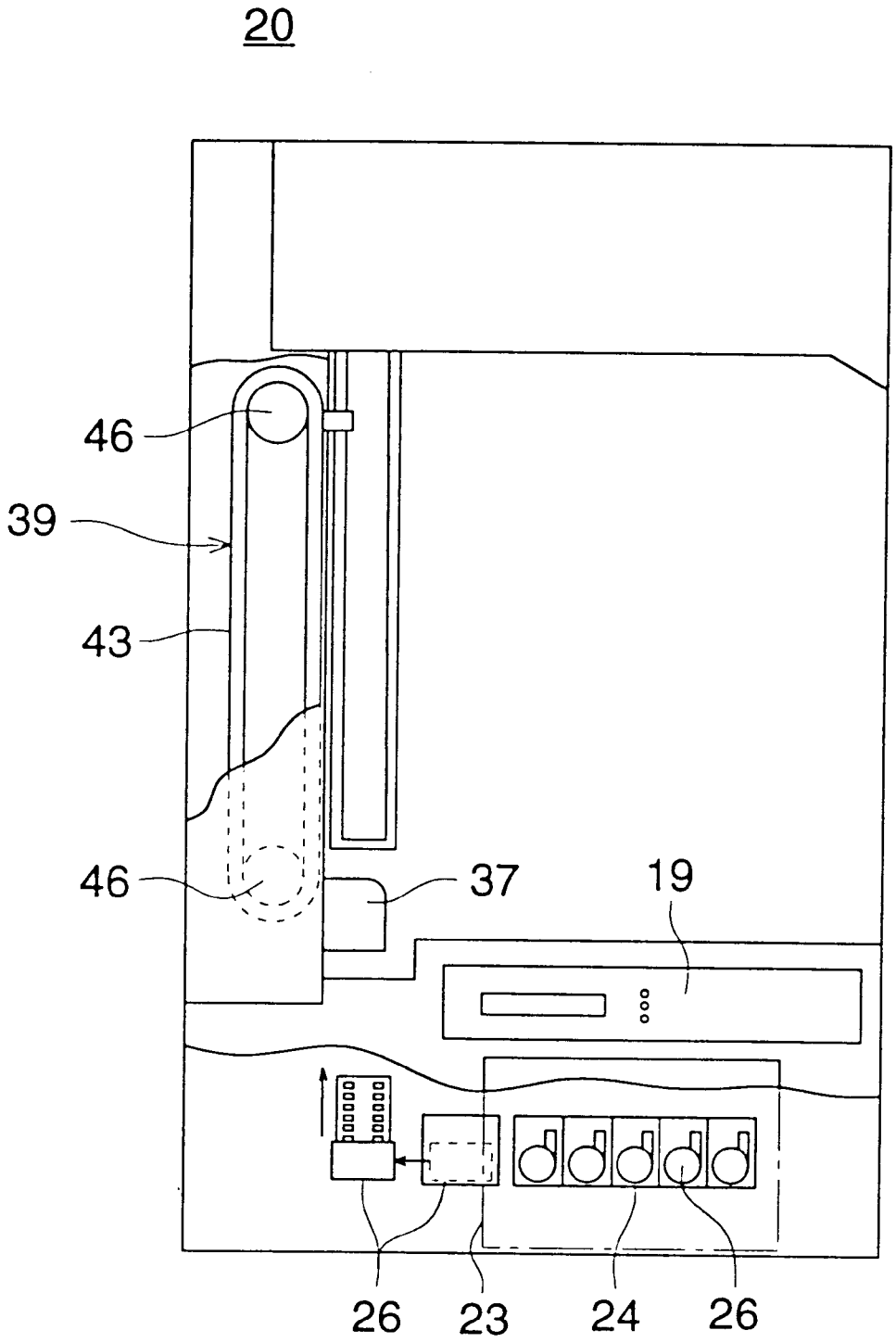
FIG. 2 is the top view of the photosensitive material processing apparatus 20.

At the inserting portion 21 covered with an opening-and-closing lid 23 (refer to FIG. 1), a plurality of cartridge receivers 24 are provided as shown in FIG. 2, so that five, in this example, of the cartridges 26 receiving a film piece respectively may be set. Accordingly, in the case where a plurality of film pieces (cartridges 26) are set, a plurality of film pieces are to be ejected successively from the ejection hole 22.

Figure 3:
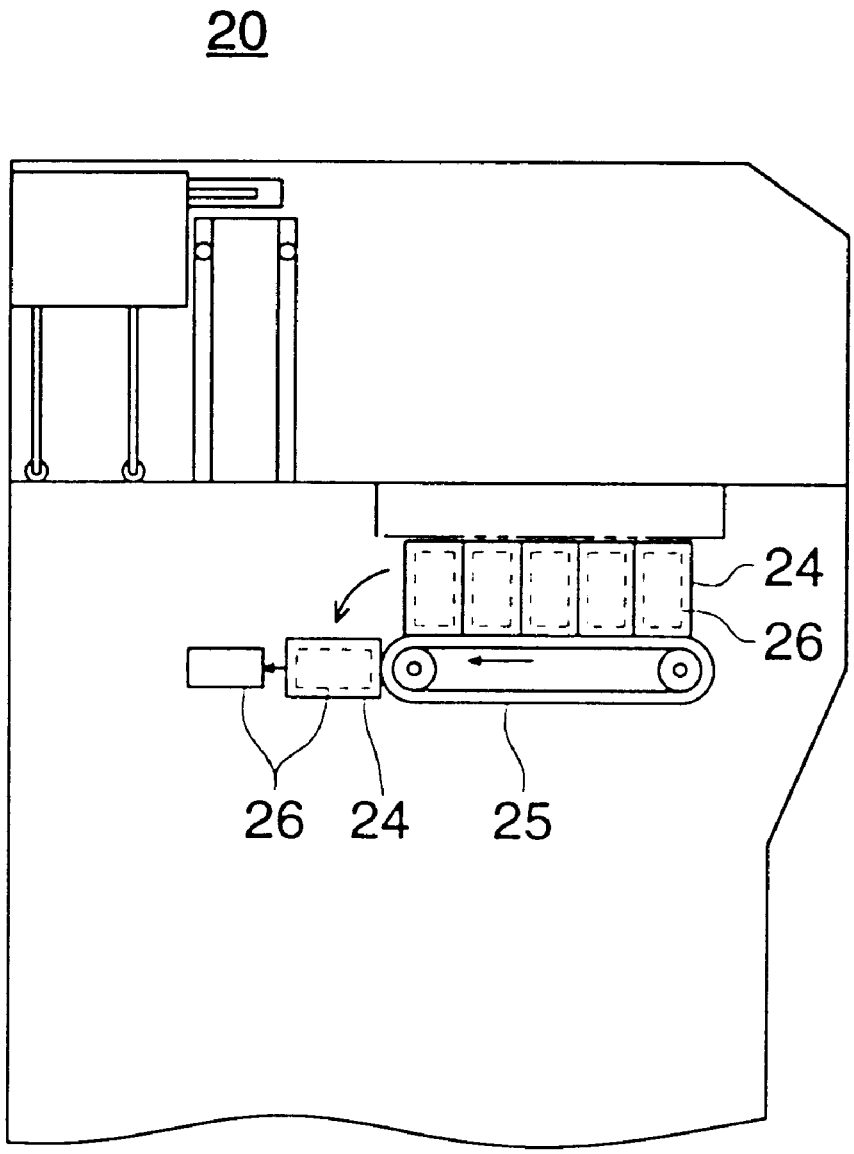
FIG. 3 is a cross-sectional view of the photosensitive material processing apparatus 20 as seen from the front.

The cartridge receivers 24 are mounted and fixed on the chain 25 as shown in FIG. 3, and are to be transported to the predetermined position at the starting of the development process. When they are transported to the predetermined position (the position where they are removed up to the most left side in FIG. 2 and FIG. 3) as shown in FIG. 2 and FIG. 3, the cartridges 26 are automatically drawn out to the left side from the cartridge receivers 24, bringing the film pieces in the cartridges 26 into a condition to be taken out.

Figure 4:
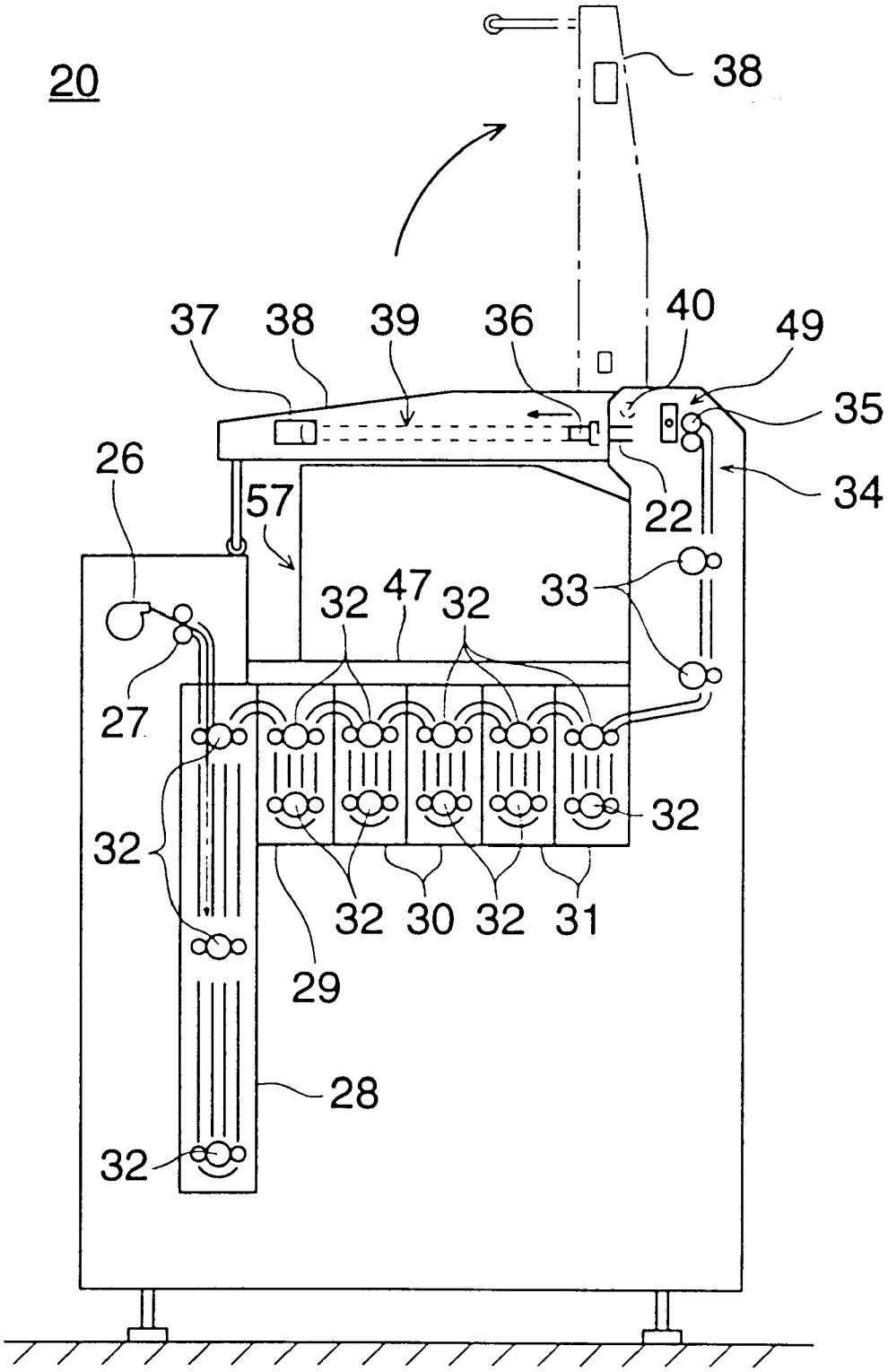
FIG. 4 is a cross-sectional view of the photosensitive material processing apparatus as seen from the side.

As shown in FIG. 4, the film pieces in the cartridges 26 are taken out by the take-out roller pair 27, and transported to the predetermined processing site at a constant speed. In the photosensitive material processing apparatus 20, the film pieces are subjected to the developing process by being transported as dipped in the processing bath in the liquid tank. For that reason, in the photosensitive material processing apparatus 20 as shown in FIG. 4, there are provided the color-developing tank 28, the bleaching tank 29, the two fixing tank 30, and the two stabilizing tanks 31, in each of which are provided the transport rollers 32 for transporting the film pieces.

In FIG. 4, when the film pieces pass the tanks successively on and after the color-developing tank 28 and finally the stabilizing tank 31, the final processing stage, they are transported to the drying portion 34 by the transport rollers 33, and dried up by eliminating the attached processing liquid. Then the dried up film pieces are ejected from the ejection hole 22 by the ejecting roller pair 35 at a constant speed.

Further, in the photosensitive material processing apparatus 20 as shown in FIG. 4, the accumulating portion 47 with a shape of a horizontal plane for accumulating the ejected film pieces is provided at a position lower than the ejection hole 22, and the leading edge of the film piece ejected is gripped to be moved in the ejecting direction with the ejection motion of the film piece, by the ejected film moving unit 38 provided at the upper portion of the apparatus, thus the leading edge of the film piece is to be gripped and held at a predetermined position, so that the film pieces should not be damaged by being rubbed when being accumulated in said accumulating portion 47.

As shown in FIG. 4, the ejected film moving unit 38 comprises the movable holding means 36 for gripping and removing the film piece, the driving means 39 for driving the movable holding means 36 (refer to FIG. 2), and the receiving means 37 for receiving the film piece from the movable holding means 36. This ejected film moving unit 38 is made to be capable of oscillating around the oscillation shaft 40, and by means of this, it is intended to improve the maintenability, for example, in a manner such that the filling up or the exchanging of the processing liquids for the respective liquid tanks positioned under the ejected film moving unit 38 is made to be easily carried out.

Figure 5:
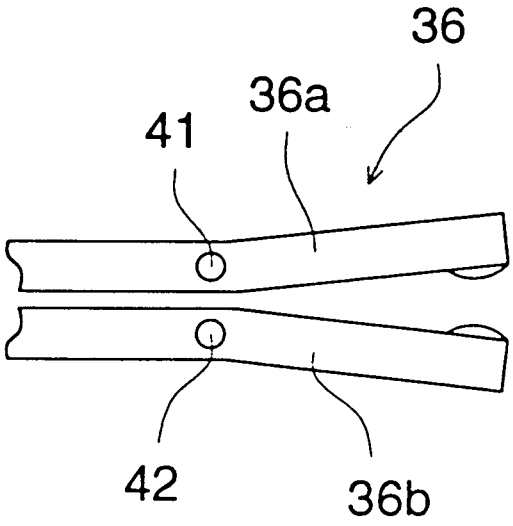
FIG. 5(A) and FIG. 5(B) are drawings showing the structure of the movable holding means 36 and the receiving means 37.
Figure 5:
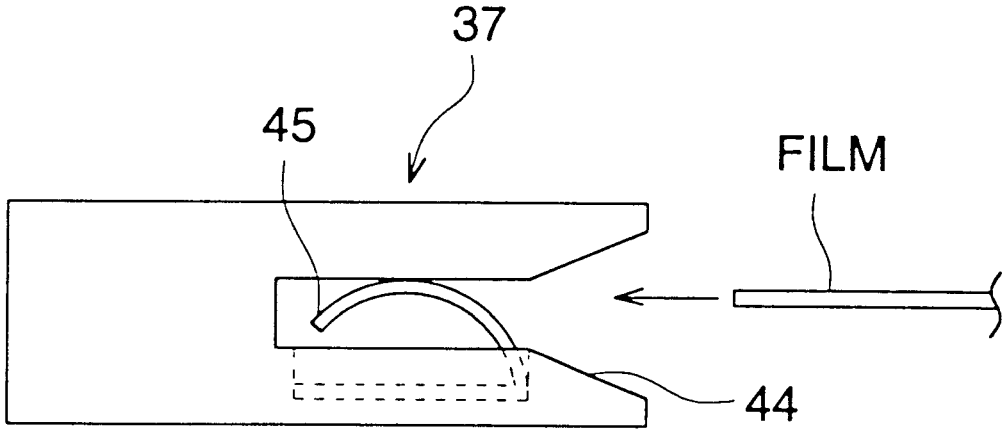

As shown in FIG. 5A, the movable holding means 36 comprises the holding arms 36*a* and 36*b* arranged at the upper and lower positions, and by the oscillation of these arms around the shafts 41 and 42, the film piece is to be gripped in between from the upper and lower directions.

This movable holding means 36 is made to be opened and closed when this means itself is moved to arrive at the respective predetermined positions by means of a cam mechanism not shown in the drawing.

In FIG. 4, the movable holding means 36 is made to be closed from the position for gripping the film pieces ejected from the ejection hole 22 to the position for delivering it to the receiving means 37. Further, it is made to be kept open after delivering the film piece until it is removed to the ready-standing position for waiting for the film to be ejected.

Regarding the opening and closing of the movable holing means 36, it is thinkable, in addition to the above-described mechanical opening and closing method, for example, that the moving position of the movable holding means 36 is detected by a sensor or the like, and a means for making opening and closing action such as a plunger is actuated on the basis of the detected signal.

On the other hand, the receiving means 37 having a shape of a small block, as shown in FIG. 5B, has a slot-shaped holding portion 44 formed on one side, in which the film pieces are made to be inserted. The film piece that is inserted in the holding portion 44 will glide down from there if it is kept as it is, therefore, the leaf spring 45 as an elastic member made up of a metal or a resin is fitted and fixed at one of the inner surfaces of the holding portion 44 (the lower surface in FIG. 5B) in order to hold the inserted film pieces.

Figure 6:
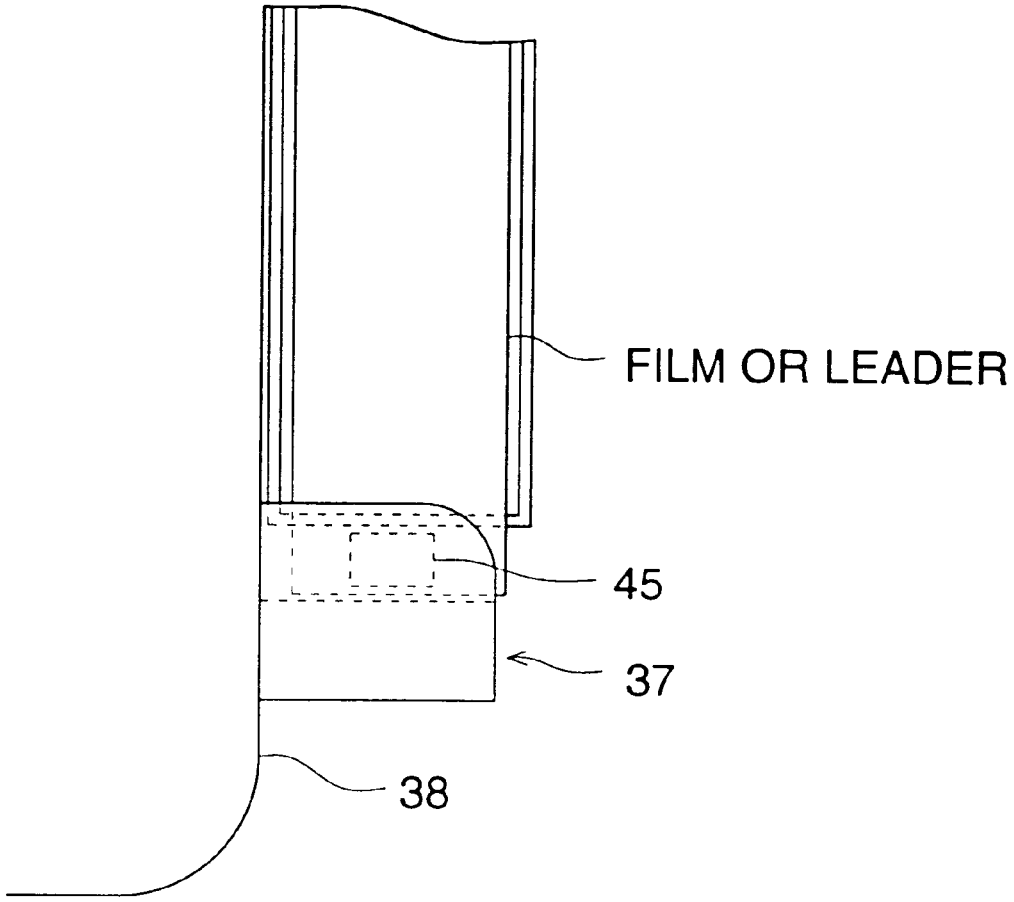
FIG. 6 is the top view of the receiving means 37 into which film pieces are inserted.

The leaf spring 45 is bent nearly in V-shape and one side of it is curved. Accordingly, as shown in FIG. 5B, the film piece is held between the other inner surface of the holding portion 44 (the upper side in FIG. 5B) and the curved portion of the leaf spring 45. FIG. 6 is the plan as viewed from the upper side of the leading edge of the film piece inserted in the receiving means 37. The receiving means 37 which is made up in this manner is designed to be able to hold up to ten pieces of the film.

Further, the driving means 39 for driving the movable holding means 36, as shown in FIG. 2, is made up of the chain 43 as an endless entrained member and, in this example, two rotary members 46 for entraining the chain around them. The two rotary members 46 are disposed at this side and deep side of the apparatus respectively, and are to be rotated clockwise by a motor not shown in the drawing. Furthermore, the movable holding means 36 is fixed to the chain 43. By means of this, the movable holding member 36 can be removed from the side of the ejection hole 22 to the side of the receiving means 37.

Incidentally, the driving means 39 is designed to operate on the basis of the detect signal which is generated when the leading edge of the film piece (the leader) is transported to the position in the vicinity of the ejection hole 22 (FIG. 4). Therefore, as shown in FIG. 4, the film detecting means 49 is provided in the transport path near the ejection hole 22.

Figure 7:
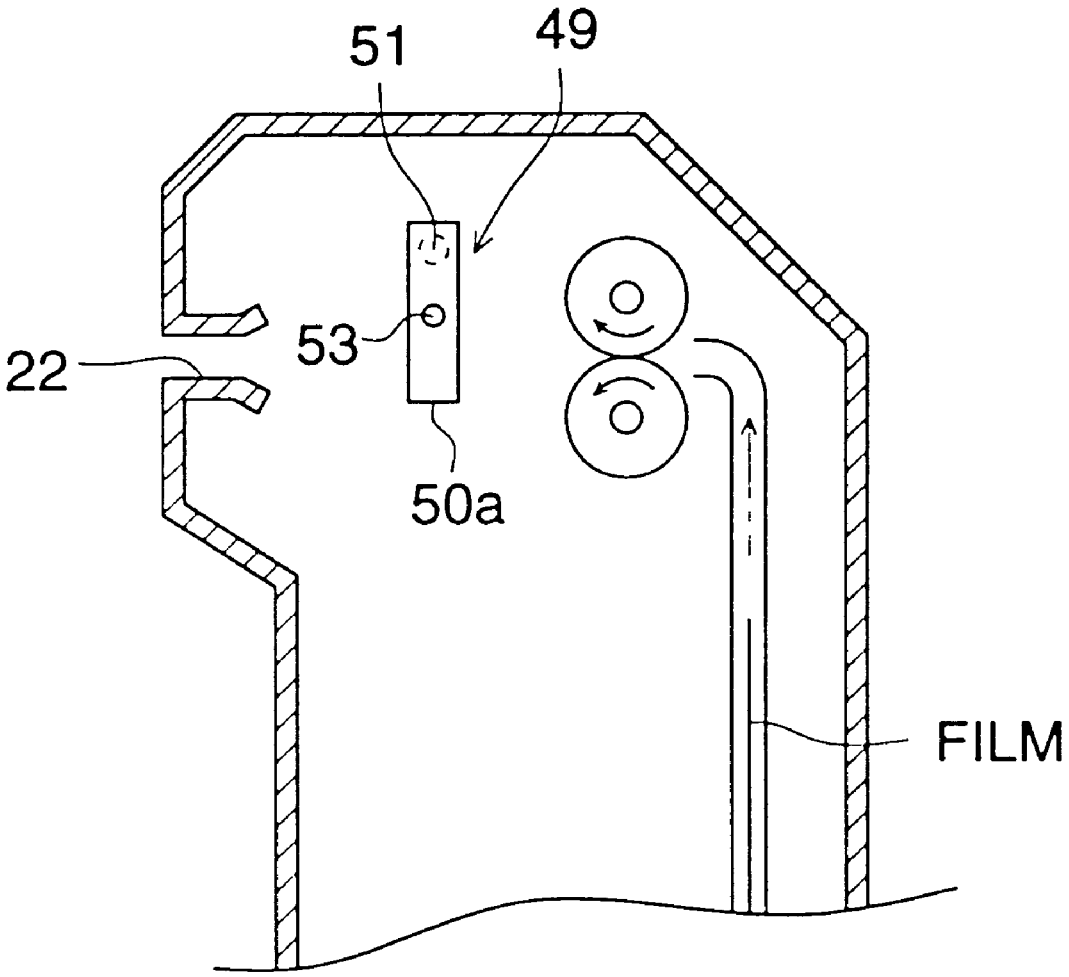
FIG. 7 is a side view (the first) of the film detecting means 49.
Figure 8:
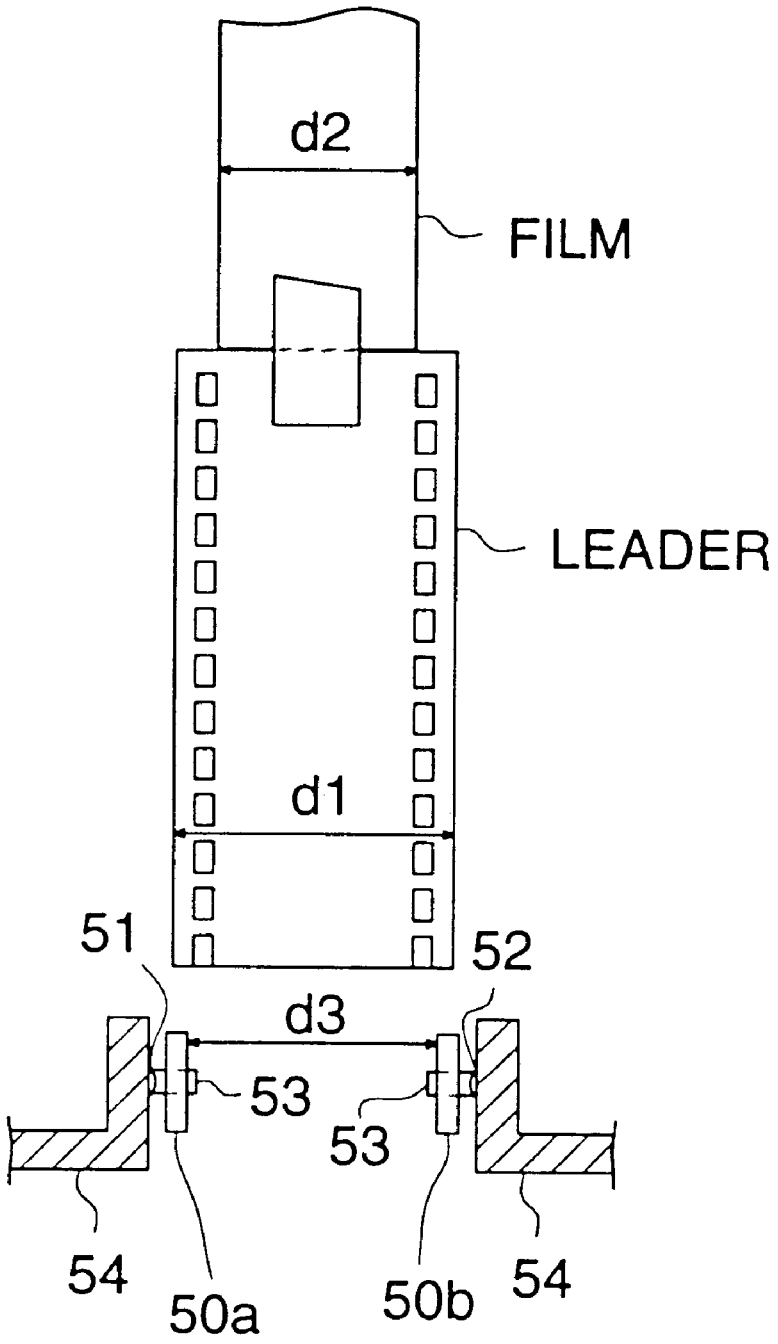
FIG. 8 is a top view (the first) of the film detecting means 49.

The film detecting means 49 comprises two plate-shaped levers 50*a* and 50*b*, the LED 51 at the light emitting side, and the photo-sensor 52 at the light receiving side, as shown in FIGS. 7 and 8. In FIG. 7 and FIG. 8, the levers 50*a* and 50*b* are fitted to the chassis 54 in such a manner as to be able to rotate around the shafts 53, so that they may be rotated when one end portion of them is hit by the film piece (the leader). In this case, each of the levers 50*a* and 50*b* is designed in a manner such that the lower half in a up-standing position is a little heavier than the upper half, so that the longer side may become vertical when the levers 50*a* and 50*b* are engaged with nothing.

Further, the levers 50*a* and 50*b* are arranged to face each other in the direction of the width of the passing film piece, with a distance d3 which is narrower than the width d1 of the film having the largest width to be used and broader than the width d2 of the film having the smallest width to be used.

Further, the LED 51 and the photo-sensor 52 are fixed to the chassis 54 at the back sides of these levers 50*a* and 50*b* respectively. When the levers 50*a* and 50*b* is oscillated, the LED 51 and the photo-sensor 52 are placed in such an arrangement as to face each other with nothing disposed in between.

Figure 9:
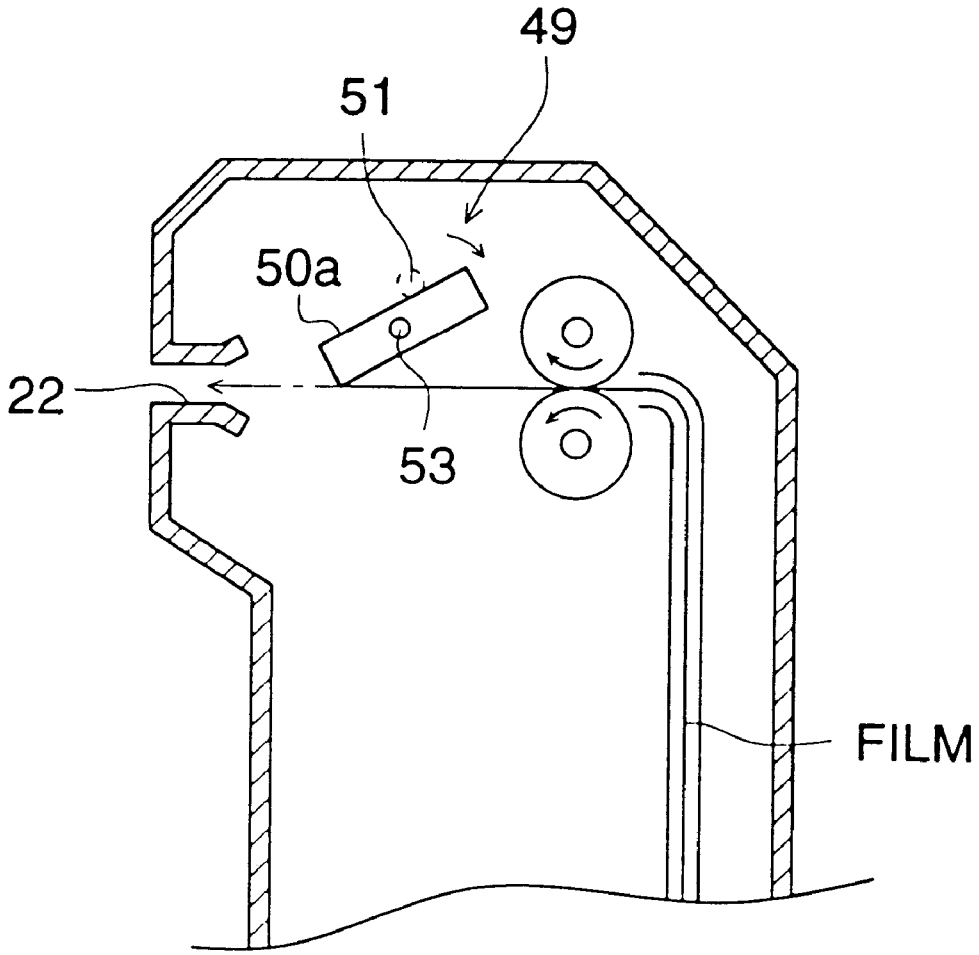
FIG. 9 is a side view (the second) of the film detecting means 49.
Figure 10:
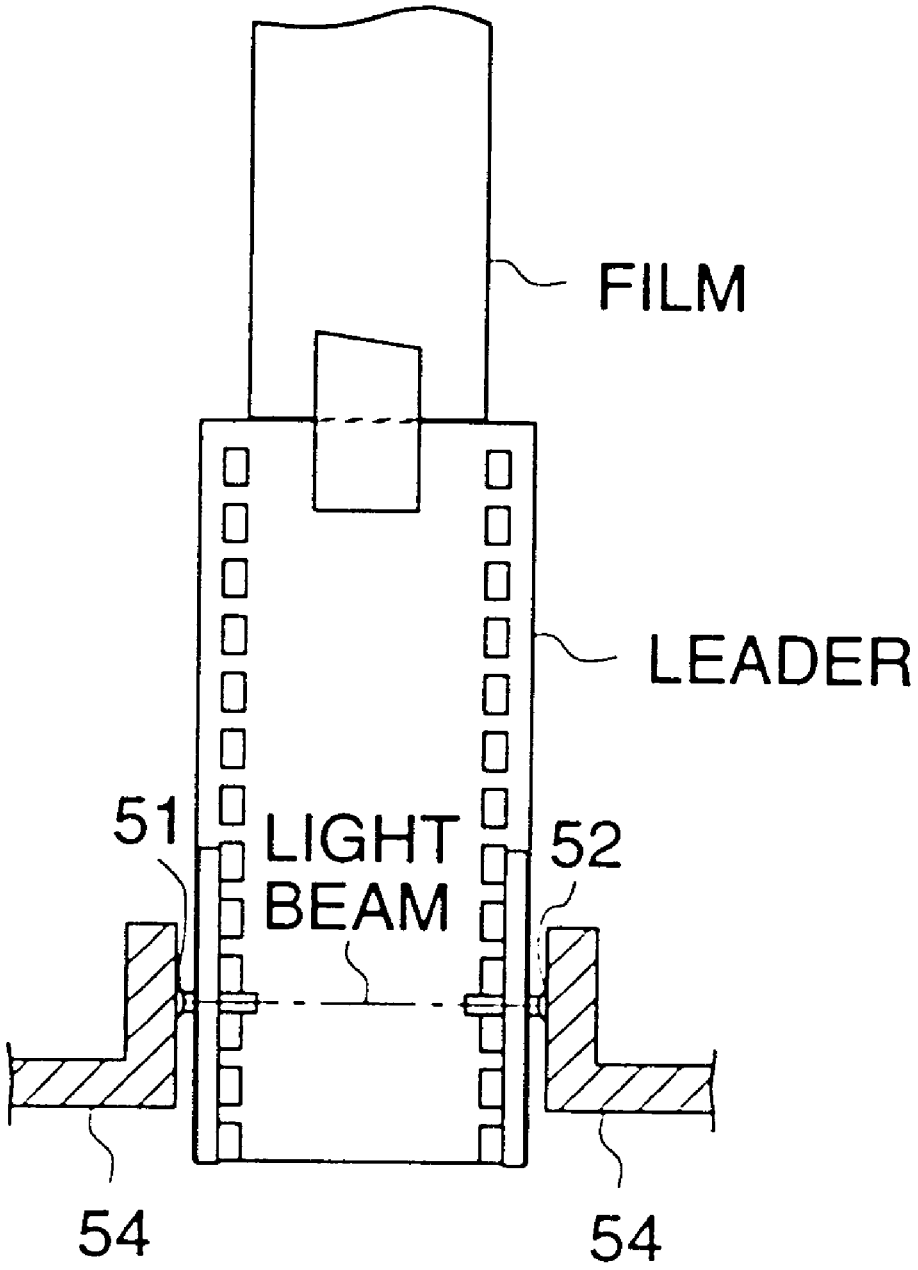
FIG. 10 is a top view (the second) of the film detecting means 49.

According to the film detecting means 49 made up in this manner, when the film piece is transported to the position near the ejection hole 22 and hits the levers 50*a* and 50*b*, as is easily understood from FIG. 9 and FIG. 10, the levers 50*a* and 50*b* are oscillated (clockwise in FIG. 9), pushed by the leading edge of the film piece.

At this time, as understood from the drawing, nothing stands in the way between the LED 51 and the photo-sensor 52 to make both directly face each other. Owing to this, the photo-sensor 52 detects the light from the LED 51. In this way, in the film detecting means 49, it is detected that the film piece (the leader) is transported to the predetermined position just short of the ejection hole 22, at the timing when the photo-sensor detects the light.

Figure 11:
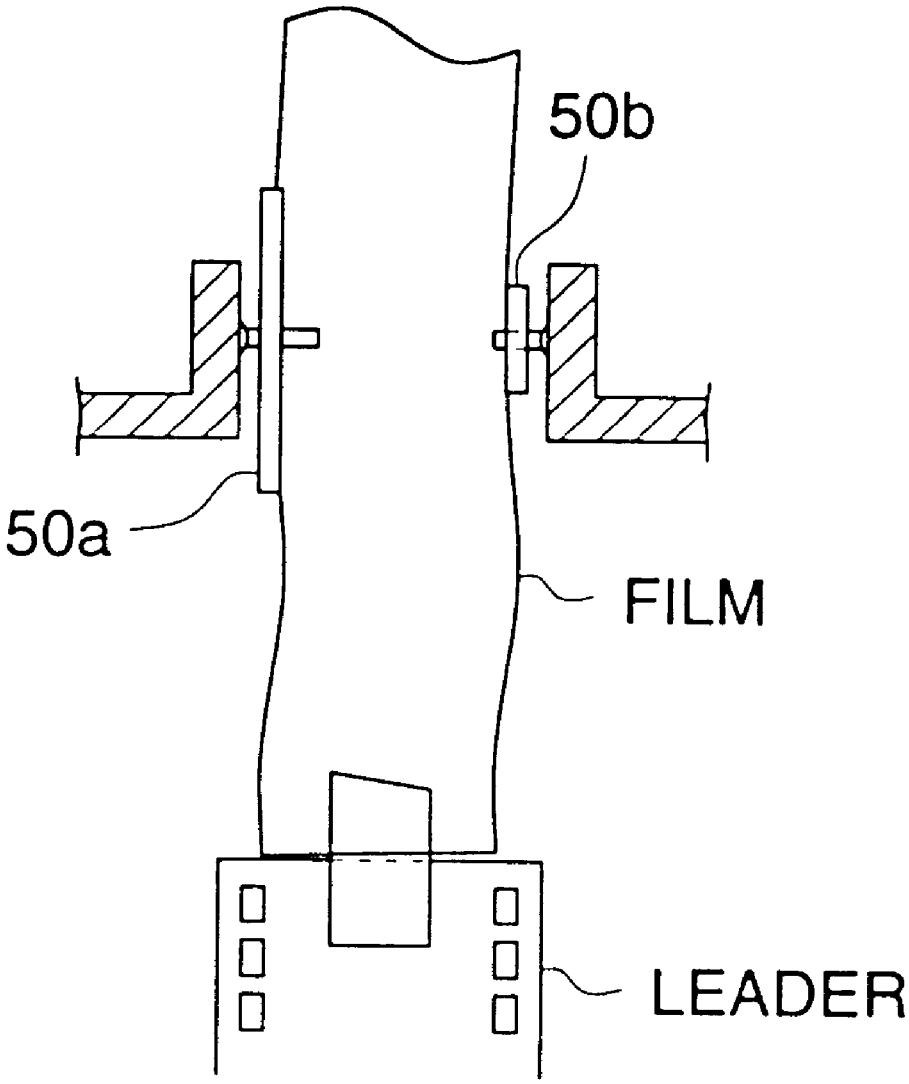
FIG. 11 is a drawing showing an example of the way of film transporting.

Further, because the two levers 50*a* and 50*b* are arranged with a distance as described in the above, in the case where a film piece is transported using a leader, even though the film piece makes the lever 50*a* oscillate by deviating to the side direction as shown in FIG. 11, for example, after the leader passes the film detecting means 49, the shielded condition of the photo-sensor 52 can be maintained while the lever 50*b* remains not oscillating.

Accordingly, even though the film piece deviates in the width direction on the way of transporting, it is prevented that the film detecting means 49 mistakes the intermediate portion of the film piece for its leading edge. Of course, also in the case where only the lever 50*b* has oscillated, the shielded condition of the LED 51 can be maintained while the lever 50*a* remains not oscillating; hence, the error in detecting the film piece can be prevented.

Figure 12:
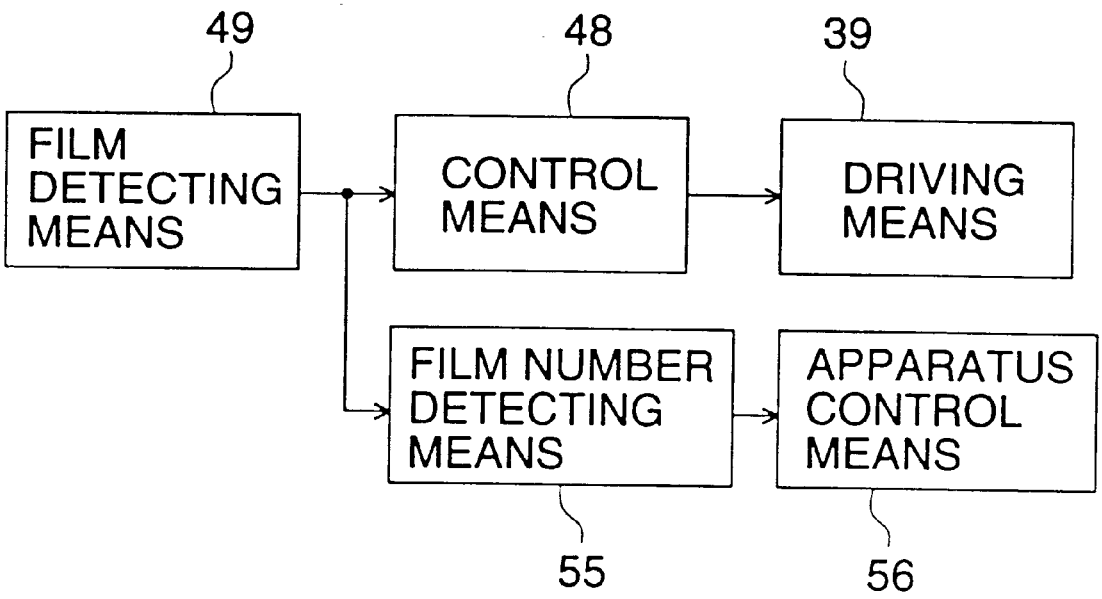
FIG. 12 is a drawing showing the circuit structure of the photosensitive material processing apparatus 20.

As is shown in FIG. 12, the detect signal by the film detecting means 49 is transmitted to the control means 48. The control means 48 is the one for controlling the driving means 39, and is to drive the driving means 39 on the basis of the detect signal by the film detecting means 49.

That is, when the leading edge portion of the film piece (the leader) just arrives at the position of the movable holding means 36 after a definite time period have passed from the detection by the film detecting means 49, the control means 48 makes the driving means 39 operate. In this case, the time period from the detection of the leading edge portion of the film piece (the leader) by the film detecting means 49 up to the actuation of the driving means 39 is set in accordance with the transport speed of the film piece.

Further, the drive speed of the driving means 39, that is, the moving speed of the movable holding means 36 fixed to the chain 43 is determined to be a slightly slower speed, for example slower by about 20%, than the film ejection speed by the control means 48.

In this manner, by making the movable holding member 36 move at a slightly slower speed than the film ejection speed, it can be prevented that the leading edge of the film piece (the leader) is pulled more than it is required to cause it to be damaged, and it can also be prevented that the film piece that has been just ejected is rubbed by another piece owing to over-slackening to cause it to be damaged.

Furthermore, as is shown in FIG. 12, the detect signal by the film detecting means 49 is transmitted to the film number detecting means 55 as well as the control means 48. In this film number detecting means 55, the number of film pieces gripped by the receiving means 37 is to be detected, by judging how many times the film detecting means 49 detects the film piece after the start of the developing process of the film. Thus, if the number of the ejected film pieces exceeds the predetermined number, five in this example, the signal from the film number detecting means 55 is outputted to the apparatus controlling means 56 for controlling the photosensitive material processing apparatus 20 generally, so that the start of the next developing process may be prohibited. In this case, the operator can be informed of the condition of the apparatus, for example, by sounding an alarming sound.

In this way, by prohibiting the start of the next developing process if the number of the ejected film pieces exceeds five, the number of the ejected film pieces never exceeds the number of the film pieces that the receiving means 37 can hold, ten pieces in this example; hence, the receiving means 37 can reliably hold the ejected film pieces.

Now, as described above, the film piece (the leader) ejected out of the ejection hole 22 has its leading edge portion moved in the direction of film ejection by the movable holding means 36; then, in the photosensitive material processing apparatus 20, the ejected film pieces are accumulated in the casing 57 (FIG. 1) as the film receiving member.

Figure 13:
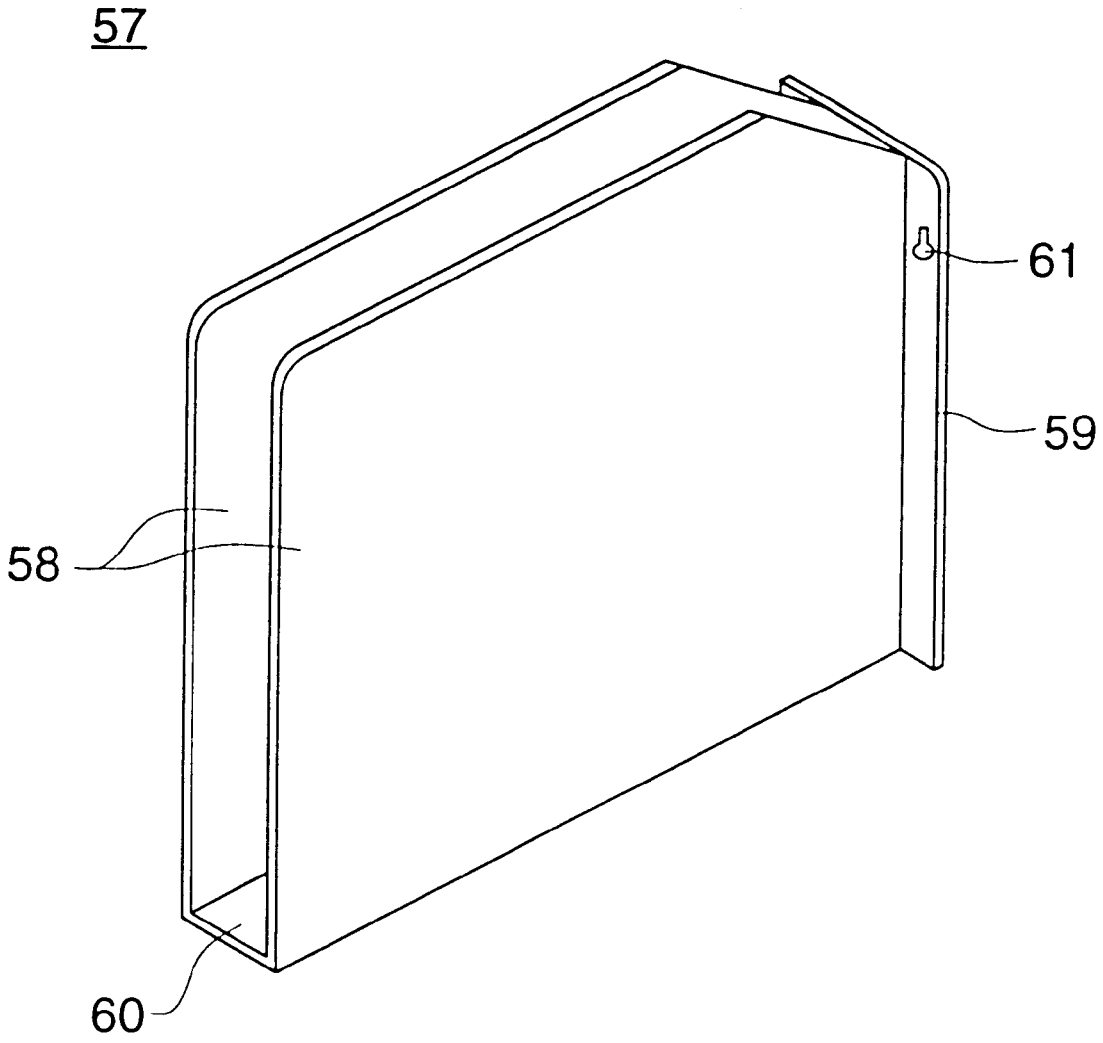
FIG. 13 is a perspective view of the casing 57.

As is shown in FIG. 13, the casing 57 is composed of the plate-shaped side plate portions 58, the bottom plate portion 60 made up of a horizontal plate that plays the same role as the accumulating portion 47, and the fitting plate portion 59 to be fitted to the apparatus mainframe. The interval "d" between the two side plate portions 58 is determined to be larger than the width of the film piece to be used and to be smaller than two times of its width.

In this case, the interval "d" between the two side plate portions 58 is suitably set at about 40 mm, because any one of the film pieces is hardly rubbed by others at the time of taking out and it is prevented that the side edges of a film piece rub the image surface of another film if the accumulating positions of the accumulated film pieces are comparatively concentrated.

Figure 14:
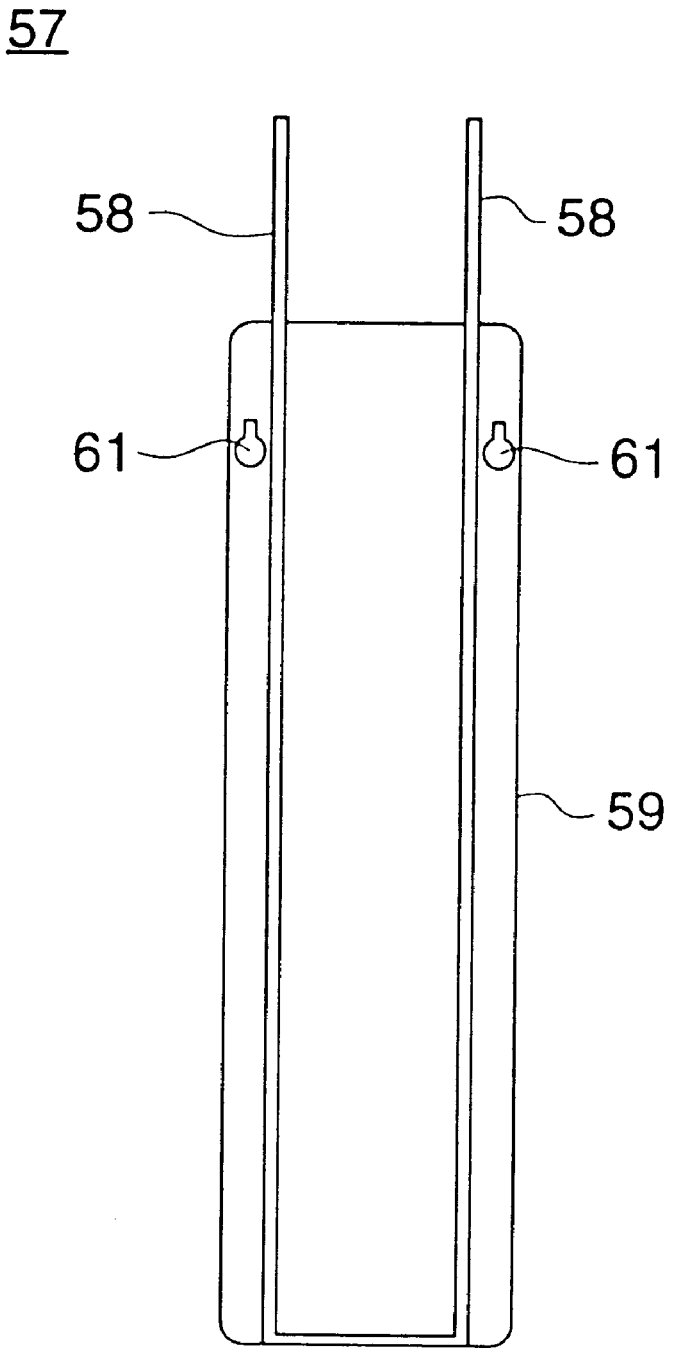
FIG. 14 is the front view of the casing 57.
Figure 15:
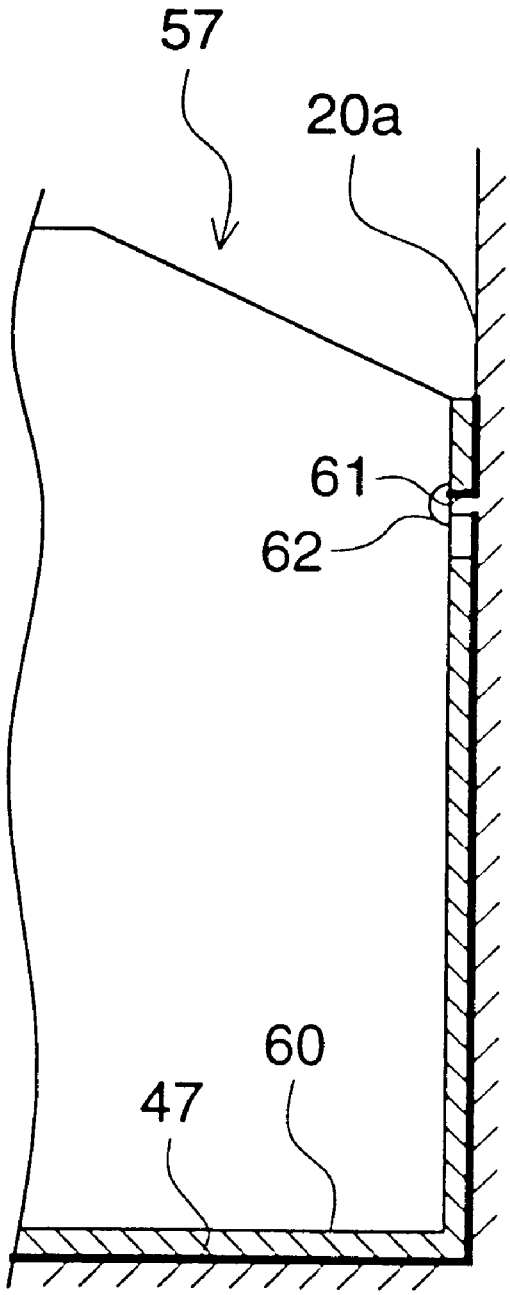
FIG. 15 is a cross-sectional view of the principal part of the casing 57.
Figure 23:
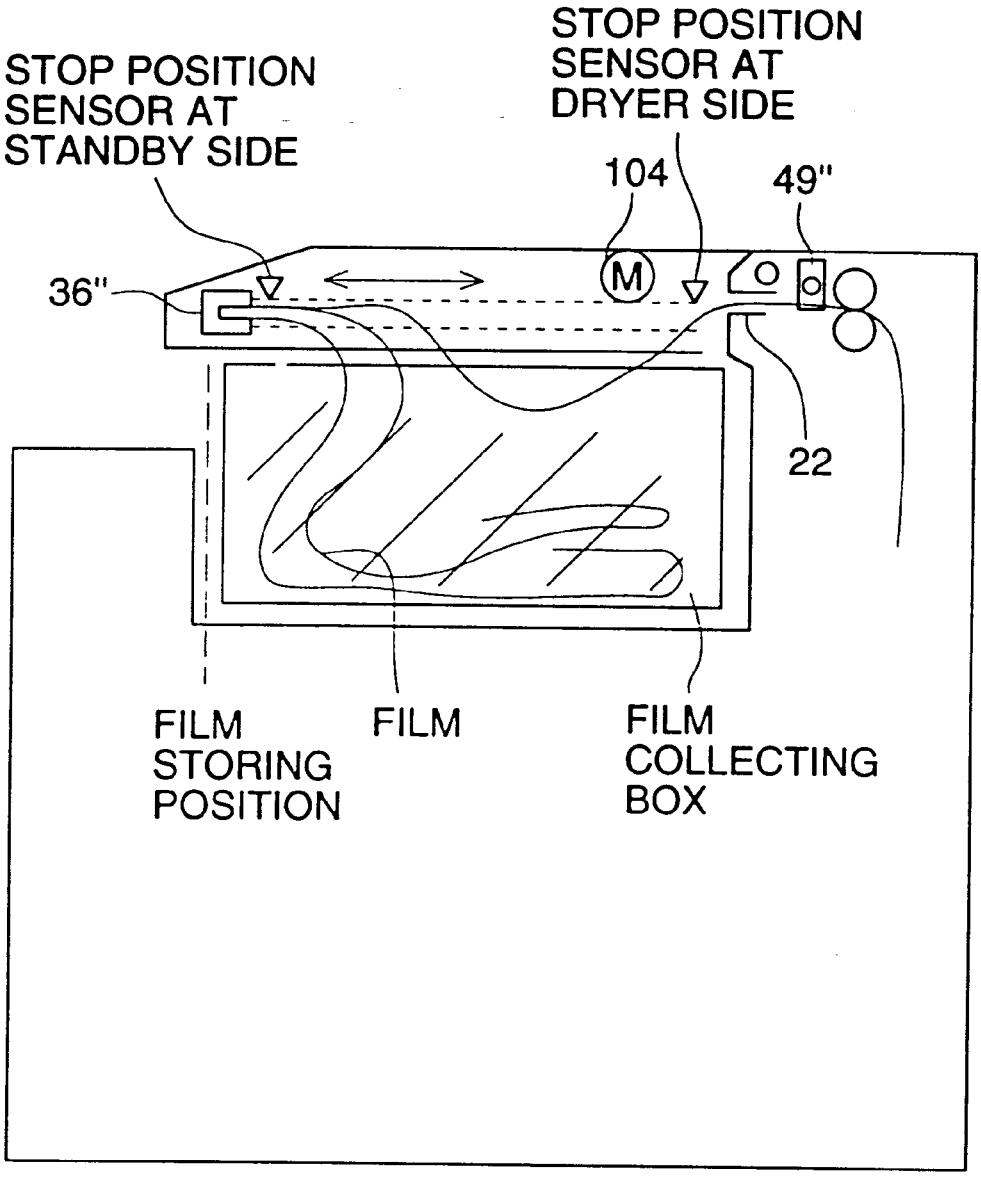
FIG. 23 is a drawing showing a further embodiment of the invention.

Further, as shown in FIG. 23 and FIG. 14, the fitting plate portion 59 is formed on one side of the side plate portions 58, and the engaging holes 61 whose upper sides narrow are bored at the upper portion of the fitting plate portion 59. As is shown in FIG. 15, these engaging holes engage with the engaging pins 62 which are fitted to the wall portion 20*a* as projected at its predetermined positions near the ejection hole 22. Owing to this, the casing 57 has its side plate portions 58 disposed at the position corresponding to the film ejecting position and its bottom plate portion 60 disposed horizontally at the position lower than the ejection hole 22. In this case, the bottom plate portion 60 is disposed as superposed on the accumulating portion 47 as shown in FIG. 15.

The casing 57 is easily detached because it is attached as hung up to the wall portion 20*a* of the photosensitive material processing apparatus 20. Accordingly, when the casing 57 is smudged owing to the dusts adhering to its inside or some other reason like that, it can be cleaned easily by detaching it from the wall portion.

Figure 16:
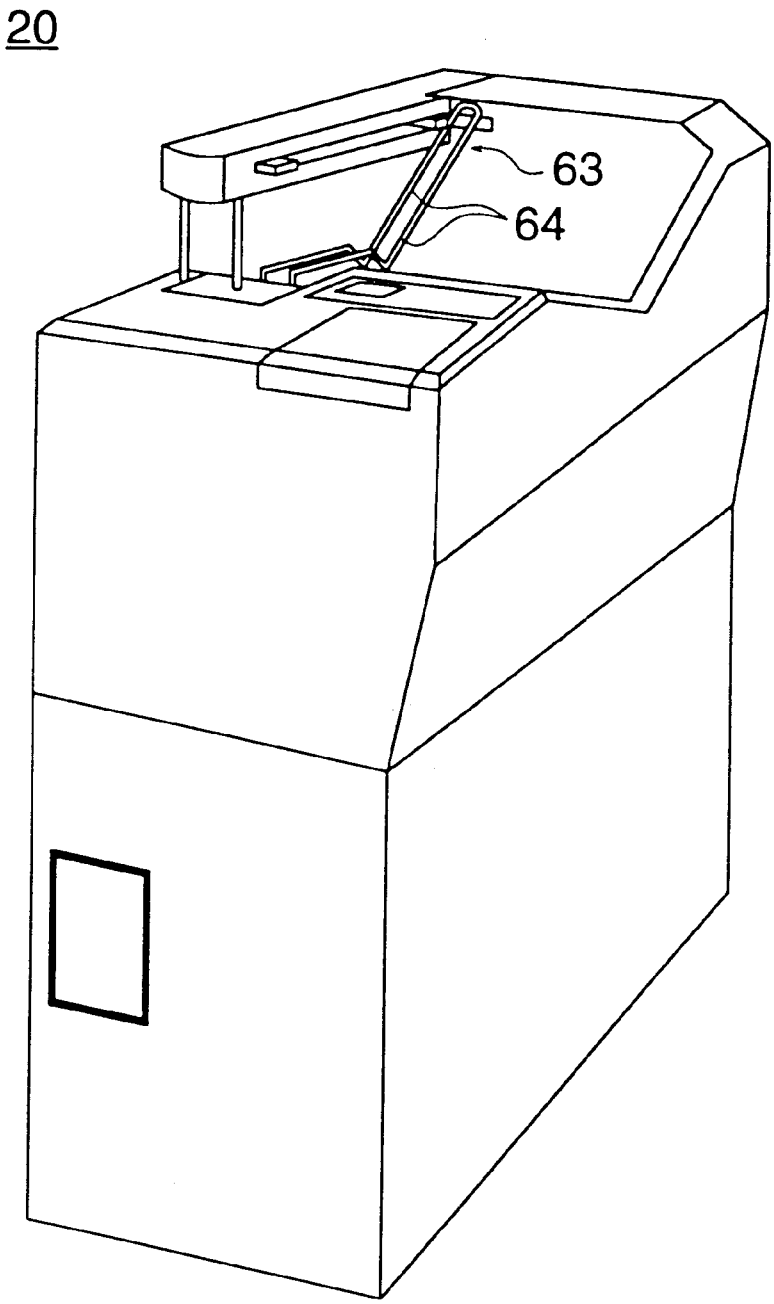
FIG. 16 is a perspective view of the photosensitive material processing apparatus 20 to which the casing 57 is fitted.

FIG. 16 shows the case where the framework 63 made up of a bending-formed bar-shaped member instead of the casing 57 is used. The framework 63 comprises bar members 64 for regulating the sidewise deviation of the film pieces when they are accumulated. The interval d of the bar members 64 is determined to be larger than the film width used and to be smaller than the two times of it; in practice, it is set at about 40 mm.

In addition, regarding the film accommodating member (the casing 57 or the framework 63), it may be appropriate to prepare several kinds of it having a different width adapted to the film size to be used and to exchange them at need.

Next, it will be explained the operation after the ejection of the film piece subjected to the predetermined processes until it is held by the receiving means 37 with reference to FIG. 4 and FIG. 17.

First, the leading edge portion of the film piece (the leader) having passed the ejection roller pair 35 is detected by the film detecting means 49. The leading edge portion of the film piece (the leader) is transported as kept intact until it is ejected through the ejection hole 22, and reaches the position of the movable holding means 36. At this time, the drive means 39 is driven on the basis of the detect signal by the film detecting means 49.

By this operation, the movable holding means 36 is moved in the direction of film ejection and grips the leading edge portion of the film piece (the leader). Then, the movable holding means 36 is moved in the direction of film ejection at a slightly slower speed than the film ejection speed and delivers the leading edge portion of the film piece (the leader) to the receiving means 37, while accumulating it in the casing 57.

At this time, the film pieces are accumulated successively as regulated with regard to the movement in the direction of their width. Accordingly, the film pieces never get twisted or entangled with one another in accumulating; hence, it can be prevented that any one of the film piece is rubbed and damaged by the side edges of others, when they are accumulated or taken out from the heap.

In particular, because the interval between the both side plate portions 58 of the casing 57 is determined to be larger than the film width and smaller than two times of the width, it can perfectly be prevented that the film pieces get twisted or entangled with one another in accumulating.

Figure 17:
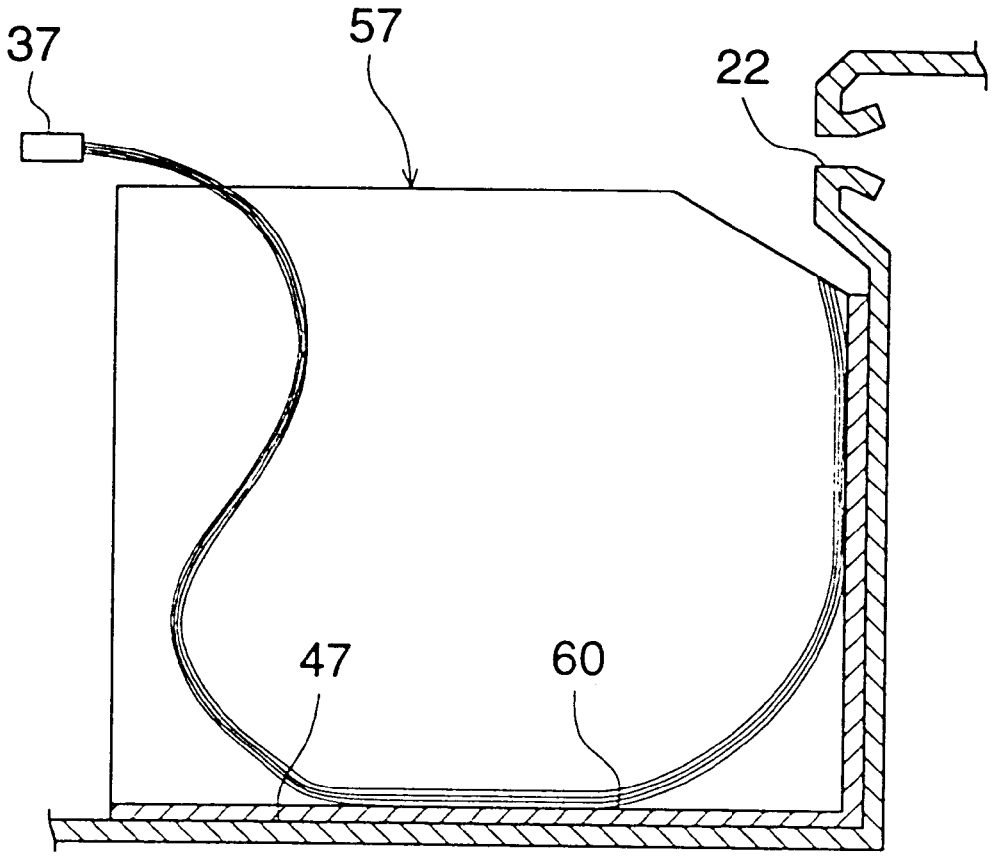
FIG. 17 is a drawing showing how the film pieces are accumulated.
Figure 18:
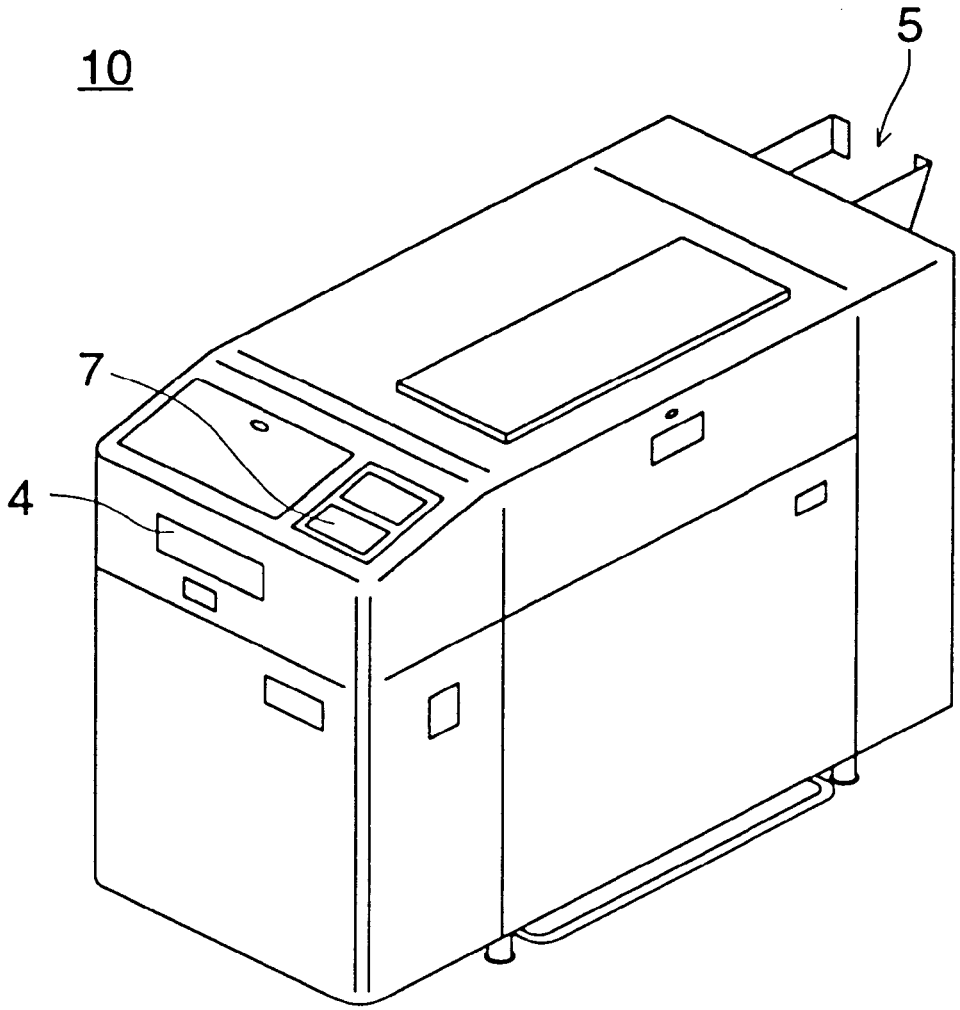
FIG. 18 is a perspective view of the conventional photosensitive material processing apparatus 10.
Figure 19:
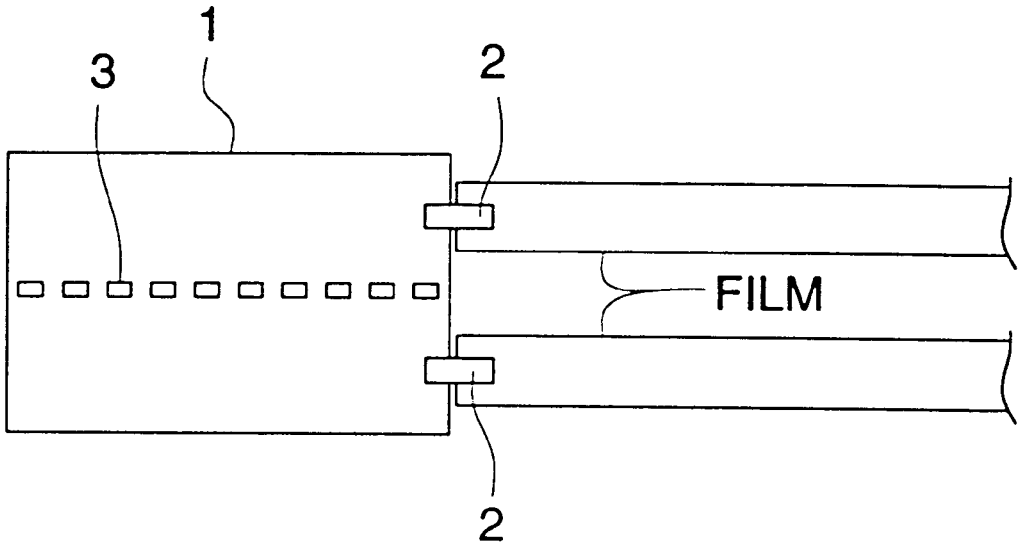
FIG. 19 is the plan of the leader 1.
Figure 20:
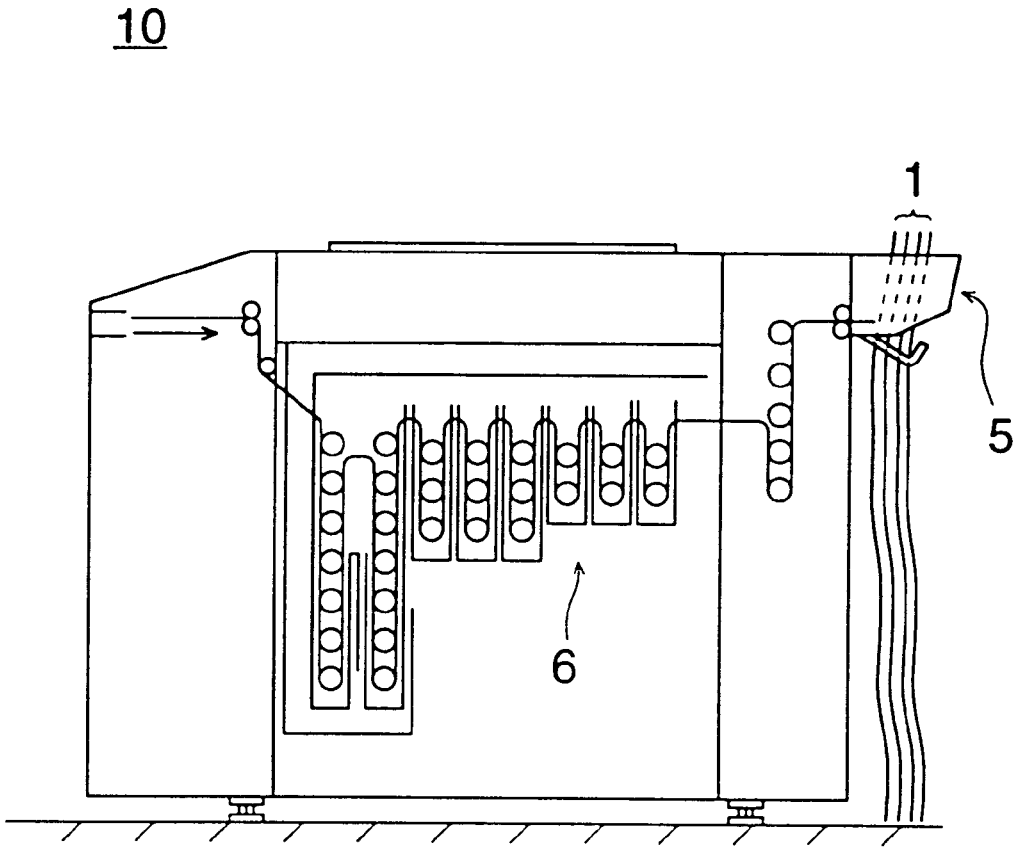
FIG. 20 is a cross-sectional view of the conventional photosensitive material processing apparatus 10.
Figure 21:
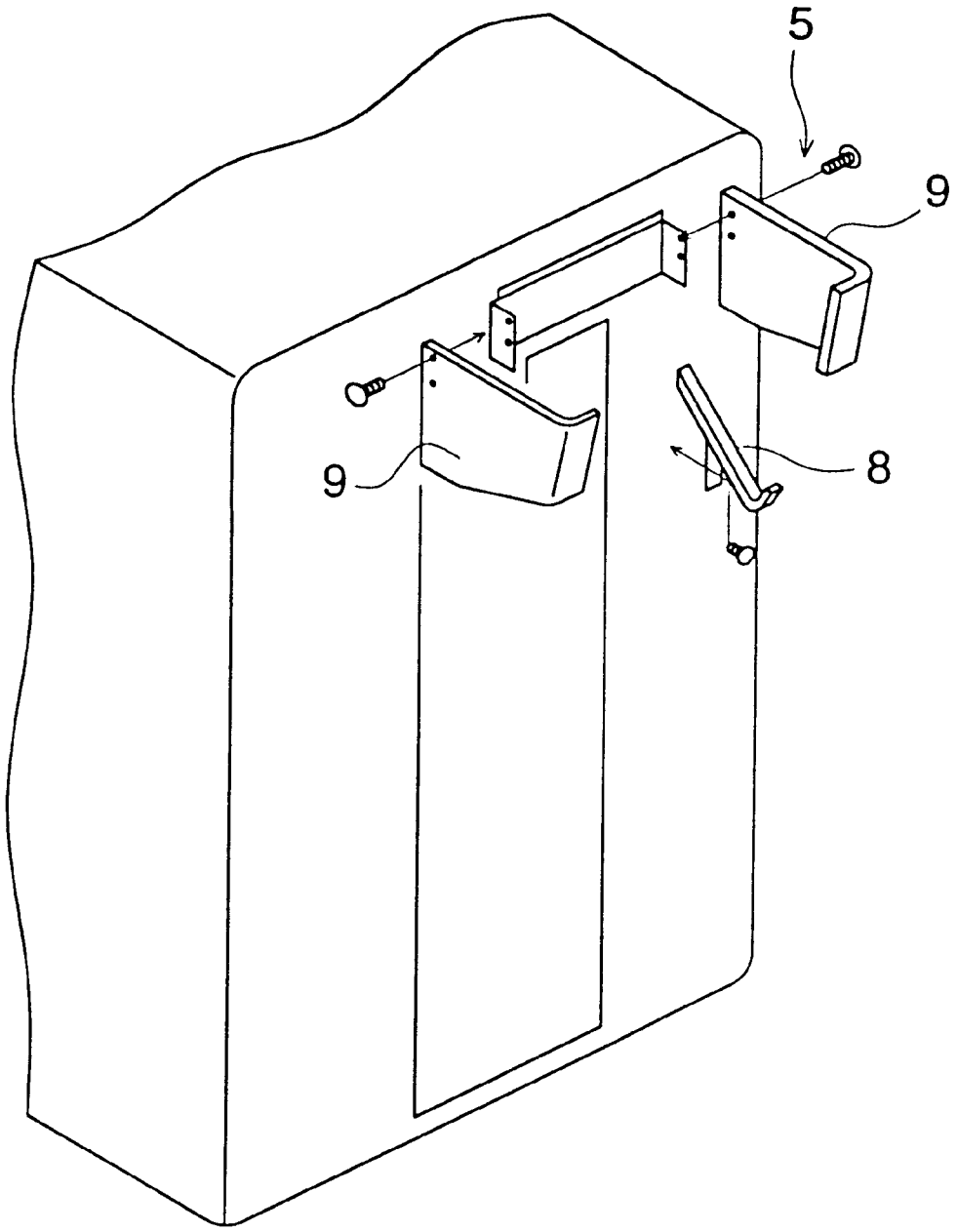
FIG. 21 is an exploded perspective view showing the structure of the leader receiving portion 5.

As shown in FIG. 17, the accumulated film pieces are held by the receiving means 37 with their leading edge portions trued up, while their other portions except the leading edge portions are placed on the bottom plate portion 60 of the casing 57. The bottom plate portion 60 is disposed horizontally at the position lower than the ejection hole 22, and as already described in the above, it performs the same role as the accumulating portion 47; hence, it can be prevented by holding the ejected film pieces stably that the respective film pieces are rubbed by others after ejection and it can also be prevented that the image surfaces of the film pieces are rubbed and get damaged by the side edges of others. It is obvious that the same effect can be obtained by the accumulating portion 47 even if the bottom plate portion 60 is not comprised.

Further, in this explanation it has been described the case where the long-sized film pieces such as the 135 mm film are used, however, even though a card-shaped film piece, not long-sized one, such as, for example, a rectangular film piece, is used, the film pieces can be transported by the movable holding means 36 and delivered to the receiving means 37 as a matter of course. Accordingly, even though the used film pieces are rectangular ones, they can be held as trued up by the receiving means 37.

Furthermore, in this example of the embodiment, the explanation has been given with regard to the case where the width of the film having the largest width among the used films is 35 mm and the width of the film having the smallest width is 16 mm; however, the invention should not be confined to this example and can be applied to the cases where the films having various sizes are used.

Moreover, in this example of the embodiment, it is explained that the film number detecting means 55 detects the number of the ejected film pieces on the basis of the detect signal by the film detecting means 49; however, the invention is not limited to this example, and it may be appropriate, for example, that the number of the ejected film is detected by detecting the thickness of the film pieces that the receiving means 37 is holding by the detecting means such as a limit switch and a pressure sensor provided at the receiving means 37.

Besides, the sensor to be used in the film detecting means may be any one of the sensors that are composed of a pair of a light emitting element and a light receiving element, and it can be made up of, for example, a photo-transistor and so forth.

Figure 22:
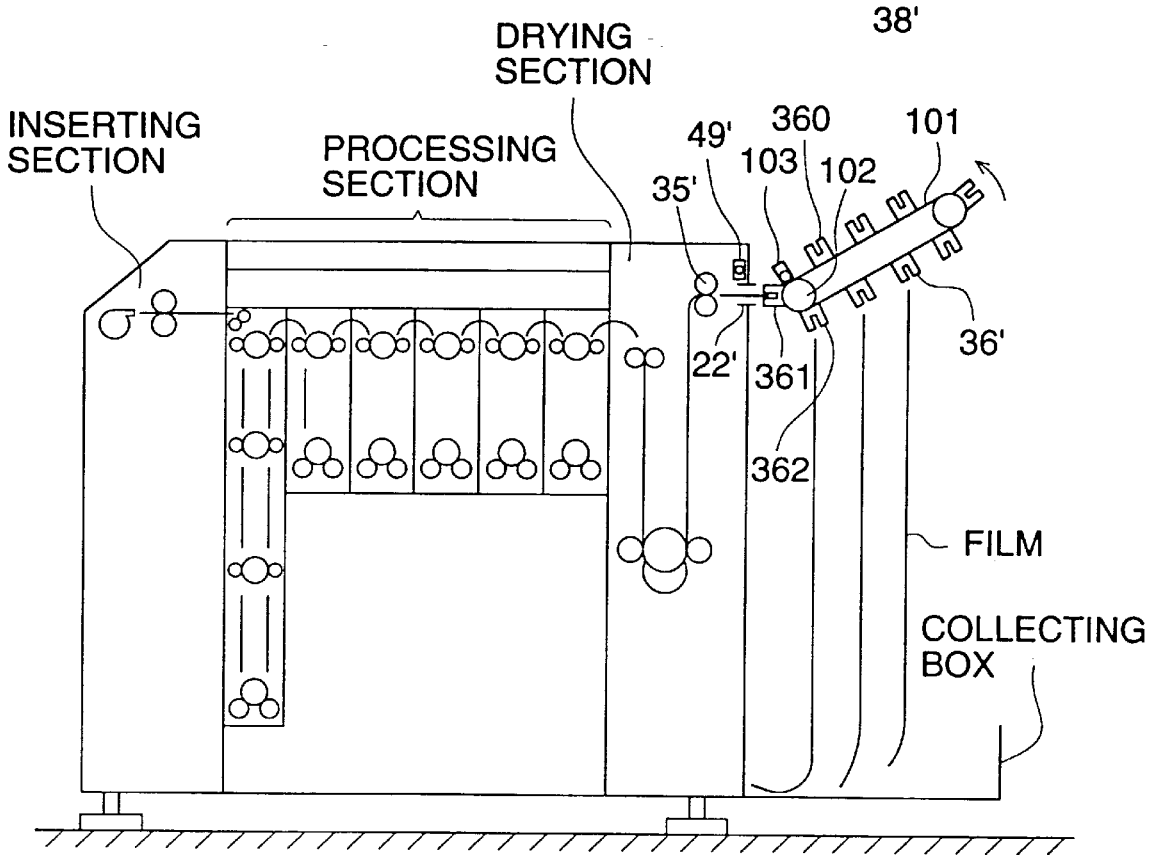
FIG. 22 is a drawing showing another embodiment of the invention.

FIG. 22 is a drawing showing another embodiment of the invention. In this embodiment, the ejected film moving unit is different from that in the above-mentioned embodiment. The ejected film moving unit 38' comprises a plurality of the movable holding means 36' provided at the endless belt 101.

In the following, the operation of the ejected film moving unit 38' will be explained.

The movable holding means 38' is composed of a plurality of the movable holding members 360, 361, 362, . . . . When the sensor 49' detects that a film piece is ejected from the ejection hole 22, the movable holding member 361 (in FIG. 22) as the movable holding means positioned near the ejection hole grips the leading edge portion of the ejected film piece. Then, after that, the motor and the encoder 102 drive the endless belt to revolve, and the movable holding member 361 is moved to the position of the movable holding member 362 in FIG. 22 by being made to stop when the stop position is detected by the stop position detecting sensor 103. Further, the movable holding member 361 is on standby at the position of the movable holding member 362 in FIG. 22 until the sensor 49' detects that the next film piece is ejected from the ejection hole 22. At that time, the above operation means that the movable holding means 360 is on standby near the ejection hole 22 until the next film piece is ejected. In this case, it may be appropriate that the endless belt is moved by a definite distance by a solenoid or the like without providing a stop position detecting sensor 103. Further, although an endless belt is employed in this embodiment, it may be appropriate to provide a rotary member in the vicinity of the ejection hole 22 instead of the endless belt, and to provide a plurality of movable holding members as the movable holding means on the circumference of the rotary member. Furthermore, it may be appropriate that some means capable of moving back and forth a plurality of movable holding means are provided instead of the endless belt.

In a low-cost apparatus, the damage of the film pieces in staying at the staying portion can be prevented because the whole film pieces can be prevented from deviating at the staying portion, and the leading edge portions of the film pieces can be easily trued up when the stayed film pieces are collected.

FIG. 23 is a drawing showing a further embodiment of the invention.

In this embodiment, when it is detected that a film piece is ejected from the ejection hole 22 by the sensor 49", the movable holding means 36" is removed from the film staying position to near the ejection hole 22 by the motor 104. Then, when the film piece is ejected from the ejection hole 22, the movable holding means 36" grips the leading edge portion of the ejected film piece, and is moved to the film staying position at a speed slower than the speed of film piece in being ejected from the ejection hole by the motor 104. Then, the movable holding means 36" is on standby until the sensor 49" detects that the next film piece is ejected from the ejection hole 22. Next, when the sensor 49" detects that the film piece is ejected from the ejection hole 22, the movable holding means 36" is removed again near to the ejection hole 22 by the motor 104 with the previously ejected film piece gripped in between, grips the film piece just in the same manner as the time when the previous film piece was ejected, and is moved to the film staying position.

Regarding the movable holding means 36", at least one has to be provided, however, a plurality of them will do also.

As for the movable holding means, one or a plurality of them will do well, however, in case of one, it should be made to have the pieces of photosensitive material held superposed together.

For the drive means for the movable holding means, a motor or the like is used, but any other drive means may be appropriate if it can make a transport between two positions.

For detecting the stop position, a mechanical limit switch or an optical photo-sensor can be employed.

The stop position detecting sensors are provided at the two positions, that is, in the drying up side and in the standby side respectively, however, the sensor provided at only one position may be enough if it is capable of detecting the positions of two points alternately.

As has been explained up to now, in the photosensitive material processing apparatus and the photosensitive material processing method according to this invention, the film pieces ejected from the ejecting portion are successively transported to the receiving means by the movable holding means, and the leading edge portions of these transported film pieces are held as trued up by the receiving means, while the other portions of the film pieces except the leading edge portions are to be placed on the accumulating portion.

Accordingly, because it can be prevented from occurring by holding the ejected film pieces stably that each of them is rubbed by others after ejection, the invention has an effect such that it can be prevented that the image surface of a film piece is rubbed and get damaged by the side edges of other film pieces.

What is claimed is:

1. A photosensitive material processing apparatus comprising:

an ejecting section to eject a photosensitive material in an ejecting direction;

a storing section to store said photosensitive material ejected from said ejecting section;

a conveyance means for moving to said storing section while supporting a leading portion, in terms of said ejecting direction, of said photosensitive material ejected from said ejecting section, thereby, conveying said photosensitive material to said storing section;

a detector for detecting a time when said photosensitive material is ejected from said ejecting section, to generate a timing signal; and a controller for controlling an operation of said conveyance means in response to said timing signal.

2. A photosensitive material processing apparatus comprising:

an ejecting section to eject a photosensitive material in an ejecting direction;

a storing section to store said photosensitive material ejected from said ejecting section, wherein said storing section comprises a casing member to place a trailing side, in terms of said ejecting direction of said photosensitive material and wherein said casing member comprises a first wall and a second wall to restrict a width direction of said photosensitive material, and an interval between said first wall and said second wall is greater than the width of said photosensitive material while being smaller than twice of it; and a conveyance means for moving to said storing section while supporting a leading portion, in terms of said ejecting direction, of said photosensitive material ejected from said ejecting section, thereby, conveying said photosensitive material to said storing section.

3. A photosensitive material processing apparatus comprising:

an ejecting section to eject a photosensitive material in an ejecting direction;

a storing section to store said photosensitive material ejected from said ejecting section;

a conveyance means for moving to said storing section while supporting a leading portion, in terms of said ejecting direction, of said photosensitive material ejected from said ejecting section, thereby, conveying said photosensitive material to said storing section; and a supporting member to support said photosensitive material conveyed to said storing section by said conveyance means, wherein said supporting member supports said photosensitive material by gripping it and is capable of gripping a plurality of said photosensitive material, and wherein said supporting member comprises an elastic member, which is deformable in a thickness direction of said photosensitive material, located at a position of gripping said photosensitive material.

4. A photosensitive material processing apparatus, comprising:

an ejecting section to eject a photosensitive material in an ejecting direction;

a holding means for holding said photosensitive material by gripping a leading portion of said photosensitive material at close proximity to said ejecting section;

a casing member to store a plurality of said photosensitive materials, in such a manner that trailing sides of said photosensitive materials are accumulated in said casing member;

a receiving means for receiving said leading portion of said photosensitive material from said holding means and, thereby, supporting said photosensitive material in said casing member; and a conveyance means for conveying said holding means, in terms of said ejecting direction, from said ejecting section to said receiving means while said holding means holds said leading portion of said photosensitive material.

5. The photosensitive material processing apparatus of claim 4, wherein said receiving means supports said photosensitive material by gripping said leading portion of said photosensitive material and is capable of gripping a plurality of said photosensitive materials.

6. The photosensitive material processing apparatus of claim 5, wherein said receiving member comprises an elastic member, which is deformable in a thickness direction of said photosensitive material, located at a position for gripping said photosensitive materials.

7. The photosensitive material processing apparatus of claim 4, wherein said casing member comprises a first wall and a second wall to restrict a width direction of said photosensitive material, and an interval between said first wall and said second wall is greater than the width of said photosensitive material while being smaller than twice of it.

8. The photosensitive material processing apparatus of claim 4, further comprising:

a detector for detecting a time when said photosensitive material is ejected from said ejecting section, to generate a timing signal; and a controller for controlling an operation of said conveyance means in response to said timing signal.

9. The photosensitive material processing apparatus of claim 4, wherein a conveying velocity of said conveyance means conveying said holding means is not greater than an ejecting velocity of said photosensitive material ejected from said ejecting section.

* * * * *